US006948565B2

(12) United States Patent
Dallas

(10) Patent No.: US 6,948,565 B2
(45) Date of Patent: Sep. 27, 2005

(54) SLIP SPOOL AND METHOD OF USING SAME

(75) Inventor: L. Murray Dallas, Fairview, TX (US)

(73) Assignee: H W C E S International, Houston, TX (US)

( * ) Notice: Subject to any disclaimer, the term of this patent is extended or adjusted under 35 U.S.C. 154(b) by 0 days.

(21) Appl. No.: 10/327,268

(22) Filed: Dec. 20, 2002

(65) Prior Publication Data

US 2003/0116326 A1 Jun. 26, 2003

(51) Int. Cl.[7] ..... E21B 33/04
(52) U.S. Cl. ..... 166/382; 166/88.3
(58) Field of Search ..... 166/307, 77.3, 166/77.4, 379, 383, 88.3, 382

(56) References Cited

U.S. PATENT DOCUMENTS

| | | | | | |
|---|---|---|---|---|---|
| 2,194,265 | A | * | 3/1940 | Abercrombie | 285/3 |
| 3,090,640 | A | * | 5/1963 | Otteman et al. | 285/3 |
| 4,244,093 | A | | 1/1981 | Klingensmith | 29/256 |
| 4,281,535 | A | * | 8/1981 | Wesch, Jr. | 73/49.8 |
| 4,646,827 | A | * | 3/1987 | Cobb | 166/88.2 |
| 4,681,193 | A | | 7/1987 | Crowe | 188/67 |
| 4,715,456 | A | | 12/1987 | Poe, Jr. et al. | 175/423 |
| 4,940,118 | A | | 7/1990 | Cox | 188/67 |
| 5,012,865 | A | | 5/1991 | McLeod | 166/90 |
| 5,027,926 | A | | 7/1991 | Cox | 188/67 |
| 5,515,925 | A | | 5/1996 | Boychuk | 166/379 |
| 5,515,926 | A | | 5/1996 | Boychuk | 166/379 |
| 5,522,464 | A | * | 6/1996 | Piper | 166/77.2 |
| 5,590,867 | A | | 1/1997 | Van Winkle | 251/1.3 |
| 5,785,121 | A | | 7/1998 | Dallas | 166/90.1 |
| 5,819,851 | A | | 10/1998 | Dallas | 166/308 |
| 5,988,274 | A | | 11/1999 | Funk | 166/77.4 |
| 6,019,175 | A | | 2/2000 | Haynes | 166/382 |
| 6,209,633 | B1 | | 4/2001 | Haynes | 166/72 |
| 6,220,363 | B1 | | 4/2001 | Dallas | 166/382 |
| 6,234,253 | B1 | | 5/2001 | Dallas | 166/377 |
| 6,289,993 | B1 | | 9/2001 | Dallas | 166/386 |
| 6,364,024 | B1 | | 4/2002 | Dallas | 166/379 |
| 6,412,560 | B1 | * | 7/2002 | Bernat | 166/301 |
| 6,595,297 | B2 | | 7/2003 | Dallas | 166/382 |
| 6,626,245 | B1 | | 9/2003 | Dallas | 166/379 |
| 6,695,064 | B2 | * | 2/2004 | Dallas | 166/382 |
| 6,817,421 | B2 | | 11/2004 | Dallas | 166/379 |
| 6,827,147 | B2 | | 12/2004 | Dallas | 166/379 |

OTHER PUBLICATIONS

U.S. Appl. No. 09/537,629 entitled "Blowout Preventer Protector and Method of Using Same", filed Mar. 29, 2000.
U.S. Appl. No. 09/791,980 entitled "Method and Apparatus for Inserting a Tubing Hanger Into a Live Well", filed Feb. 23, 2001.

(Continued)

*Primary Examiner*—Frank Tsay
(74) *Attorney, Agent, or Firm*—Nelson Mullins Riley & Scarborough, LLP

(57) ABSTRACT

A slip spool for selectively supporting a tubing string suspended in a wellbore can be mounted to a wellhead. The slip spool has an axial passage that is aligned with the wellbore, and at least two radial passages extending through a side wall of the slip spool and communicating with the axial passage. At least two slip assemblies are slidably received within the respective radial passages. Actuators move the respective slip assemblies between a retracted position in which the slip jaws clear the axial passage of the slip spool, and an extended position in which wedge-shaped slip jaws of the respective slip assemblies are inserted into an annulus between the axial passage of the slip spool to grip the tubing string.

17 Claims, 8 Drawing Sheets

OTHER PUBLICATIONS

U.S. Appl. No. 09/998,953 entitled "Spool for Pressure Containment Used in Rigless Well Completion, Re–Completion, Servicing or Workover", filed Nov. 15, 2001.

U.S. Appl. No. 10/034,032 entitled "Slip Spool and Method of Using Same", filed Dec. 19, 2001.

U.S. Appl. No. 10/050,024 entitled "Well Stimulation Tool and Method of Using Same", filed Jan. 15, 2002.

U.S. Appl. No. 10/162,773, entitled "Welll Stimulation Tool and Method of Using Same", filed Jun. 4, 2002.

U.S. Appl. Ser. No. 10/336,911, entitled "Backpressure Adapter Pin and Methods of Use,"filed Jan. 6, 2003.

U.S. Appl. Ser. No. 10/912,894, entitled "Backpressure Adapter Pin and Methods of Use,"filed Aug. 6,2004.

* cited by examiner

SLIP SPOOL AND METHOD OF USING SAME

FIELD OF THE INVENTION

The present invention relates to slip assemblies for supporting tubing in a wellbore, and more particularly to a slip spool used to selectively support a tubing string during a live well operation.

BACKGROUND OF THE INVENTION

In the oil industry slips have been essential components of oil field drilling and servicing equipment for many years. Conventional slips are sets of heavy hinged blocks with gripping dies that are positioned in a slip bowl of a rotary table to engage tubing, such as drill pipe, casing or production tubing suspended in a wellbore. Angled surfaces in each slip block mate with angled surfaces in the slip bowl. The angled surfaces cause axial forces exerted on the slip blocks by the weight of the tubing to be transferred into lateral gripping pressure on the tubing. The gripping pressure supports the tubing and prevents it from slipping down through the slips into the wellbore.

As is well known in the art, conventional slips are manually engaged by oil field personnel who maneuver the slips into the slip bowl so that they slide into engagement with a casing, drill or production tubing pipe. The slips are disengaged by upward axial movement of the casing, drill pipe, or production tubing to remove weight from the slips. The slips are then lifted out of the slip bowl. An example of such conventional slips is described in U.S. Pat. No. 4,244,093, entitled TURBINE SLIP PULLING TOOL, which issued to Klingsensmith on Jan. 13, 1981.

There is an ever increasing demand for producing more oil and gas from existing wells. After a primary recovery term of a well has expired, some form of reworking is required to produce at least a portion of the remaining oil and/or gas from the well. In reworking a well, such as in preparation for a well stimulation process, the tubing string must be removed from the well or pulled up to permit the tubing hanger to be removed so that stimulation fluids can be pumped down through an annulus between the production tubing and the casing. During such operations the tubing string is supported as required, by slips. It is therefore necessary to set and remove the slips during preparation for a well stimulation process. Consequently, slips are not only frequently used during well drilling and completion, they are also essential equipment for well re-completion, servicing and workover.

It has been increasingly apparent that well serving and workover are best performed under "live well" conditions. A live well is a well in which downhole pressure are controlled by wellhead equipment. As is well known, slip assemblies generally do not provide pressure seals to inhibit the escape of hydrocarbons from the well. Consequently, the use of slip assemblies over a live well generally requires either the use of hydril blowout preventers in conjunction with ram-type blowout preventers, to control well pressures unless the well is "killed" by pumping in a overbearing fluid, such as drilling mud to prevent fluids from escaping from the well. Either option contributes significantly to treatment costs. Each option also has other disadvantages. For example, killing a well can reverse the beneficial effects of a well stimulation process. On the other hand, the use of one or more hydril blowout preventers significantly raises working heights, making the well more difficult to work and compromising worker safety.

There therefore exists a need for a pressure containing slip spool that integrates into a wellhead control stack to overcome the shortcomings of the prior art slip assemblies, while being robust and reliable enough to support even very long strings of coiled or jointed tubing.

SUMMARY OF THE INVENTION

An object of the present invention is to provide a pressure containing slip spool for selectively supporting a tubing string suspended in a wellbore, which integrates into the wellhead control stack and has a height—that does not interfere with well servicing operations.

Another object of the invention is to provide an apparatus for selectively supporting a tubing string suspended in a wellbore, which can be operated under well pressure while significantly improving operator safety.

The invention therefore, provides a slip spool that can be mounted to a wellhead for selectively supporting a tubing string suspended in the wellbore. The slip spool has an axial passage that is aligned with the wellbore for permitting a tubing string to extend therethrough, and at least two radial passages extending through a side wall of the slip spool and communicating with the axial passage. The radial passages extend inwardly and downwardly at a first angle relative to a central axis of the axial passage. Each of the radial passages accommodates a slip assembly that is slidably received within the radial passage. Slip jaws are pivotally mounted to and slidable together with respective slip anchors of the slip assemblies. The slip spool further includes means for moving the respective slip anchors with the slip jaws between an extended position in which the respective slip jaws are inserted into an annulus between the tubing string and the axial passage for gripping the tubing string, and a retracted position in which the slip jaws clear the axial passage to provide full bore access through the slip spool.

Each slip jaw has a gripping surface and a bearing surface forming a second angle therebetween which is more acute than the first angle. The axial passages through the sidewall of the slip spool preferably comprises a slip seat for each slip jaw. The slip seat extends at an angle with respect to an axis of the axial passage. The angle is substantially equal to the second angle defined by the slip jaw. The bearing surface of each of the slip jaws rests on the slip seat of the slip spool, and the gripping surface of each of the slip jaws grips an exterior surface of the tubing string when the slip jaws are in the extended position. Thus, axial forces exerted by the tubing string on the slip assemblies are transferred into lateral gripping pressure on the tubing string, thereby supporting the tubing string and preventing the tubing string from slipping through the slip jaws.

In one embodiment of the present invention a link member pivotally interconnects each slip jaw to its corresponding slip anchor. Each link member pivots about a first and second pivot axes. The first and second pivot axes are parallel to each other and are perpendicular the axis of the corresponding radial passage so that the slip jaw is permitted to move slightly downward relative to the longitudinal axis of the radial passage, under the weight of the tubing string when the slip anchor is in its extended position and the slip jaw rests on the slip jaw seat. This permits the slip jaw to lodge into the annulus between the slip seat and the exterior surface of the tubing string, thereby providing a secure support to the tubing string. Actuators mounted on the slip spool reciprocate the slip assemblies within the respective radial passages.

The slip spool is adapted to be sealingly mounted to a wellhead of a live well, and the slip spool in accordance with the invention permits slips to be set or released in a convenient and safe manner under live well fluid pressures. The slip spool in accordance with the invention also has a low profile, which is convent to work around. Slip spool in accordance with the invention can also be invented in a control stack and used to snub tubing in high-pressure wells when fluid pressure overbears string weight.

Other advantages and features of the present invention will be better understood with reference to preferred embodiments of the present invention described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENT

The present invention provides a slip spool for selectively supporting a tubing string suspended in a wellbore, and methods for using the slip spool during completion or maintenance procedures. The slip spool can be used to support a coil tubing string or a jointed tubing string. The slip spool provides a sealed axial passage and can be operated under well pressure, so that during a live well procedure it is not necessary to kill the well at any time.

The slip spool can also be left in place during the entire well procedure, so that labor is reduced and safety is improved. The slip spool is useful for any well completion, re-completion or servicing procedure if tubing or other components must be run into or out of the well. Used in conjunction with other pressure containment components, such as high pressure valves, landing spools, or tubing adaptors the slip spool permits live well operations with only one blowout preventer. Consequently, well procedure equipment costs are reduced and working height is reduced. Worker safety is thereby improved and the work progresses more quickly.

Figure 1:
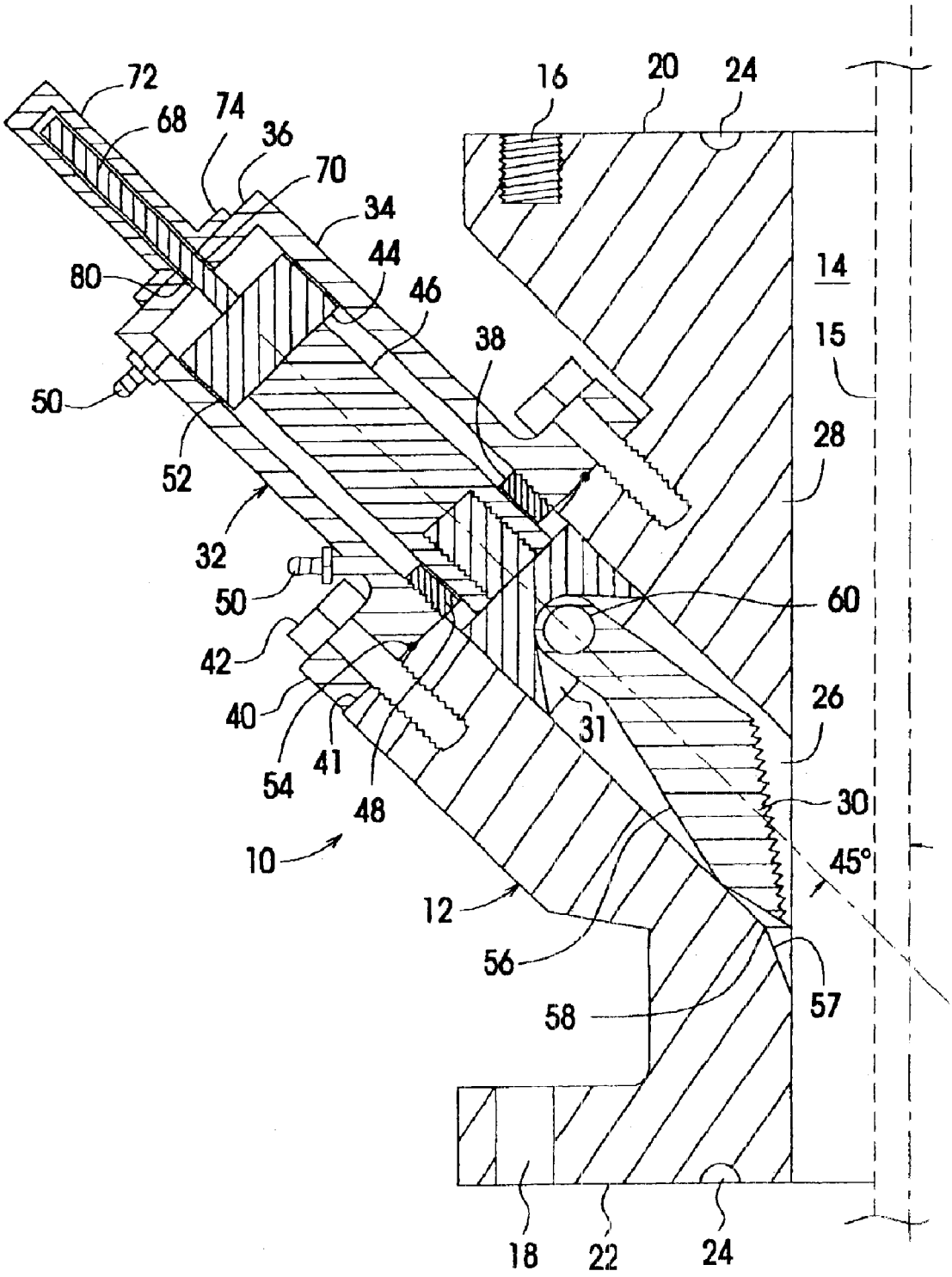
FIG. 1 is a partial cross-sectional view of a slip spool in accordance with one embodiment of the present invention, showing a slip assembly in a retracted position.
Figure 2:
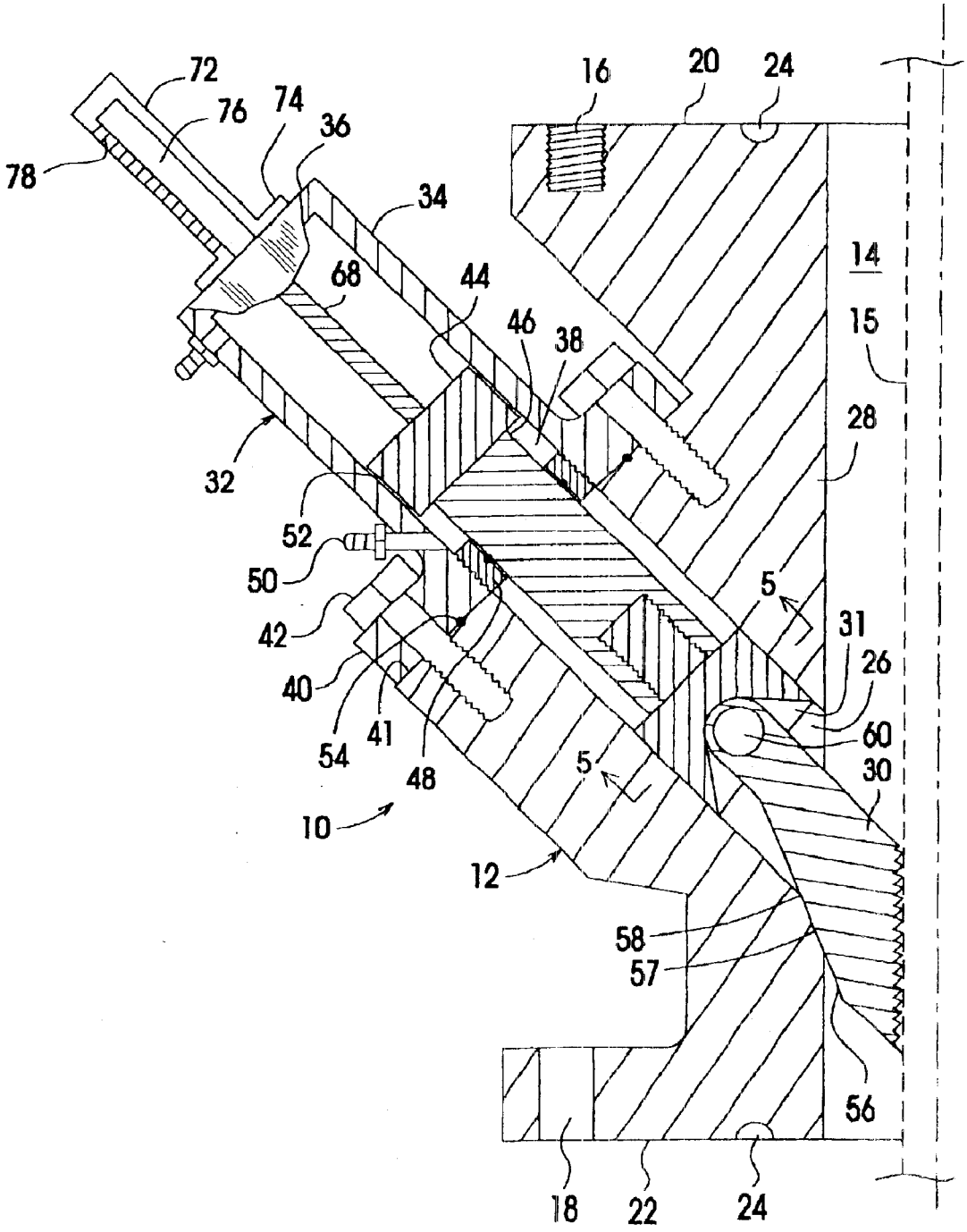
FIG. 2 is a partial cross-sectional view of the slip spool shown in FIG. 1, illustrating the slip assembly in an extended position, with a slip jaw of the slip assembly seated on a slip seat formed in the radial passage of the slip spool.

FIGS. 1 and 2 schematically illustrate a slip spool 10 in accordance with one embodiment of the invention, in a partial cross-sectional view. The slip spool 10 includes a spool body 12 having an axial passage 14 that aligns with the wellbore and provides full-bore access when the slip spool 12 is mounted to a wellhead. A bottom flange 22 includes mounting bores 18 for bolting the slip spool 12 to a top of another spool, such as a blowout preventer (BOP) or the like. A stud pad 20 of the slip spool 12 includes threaded bores 16 for receiving studs for mounting another spool, Bowen union or adapter to a top of the slip spool 12. Annular grooves 24 provided in the stud pad 20 and the bottom flange 22 respectively receive a gasket seal (not shown) when the slip spool 12 is mounted to the wellhead to provide a fluid seal between adjacent spools in a manner well known in the art.

The spool body 12 is also provided with at least two radial passages 26 (only one shown) that extend through a side wall 28 and communicate with the axial passage 14. Each of the radial passages 26 extends inwardly and downwardly at an angle of, for example, 45° relative to an central axis of the axial passage 14.

Each radial passage 26 includes a downwardly angled slip seat 57 for supporting a respective slip jaw 30. The angle between the slip seat 57 and the axis of the axial passage 14 is, for example, 26° or less, which is substantially more acute than the angle between the axis of the radial passage 26 and the axis of the axial passage 14. The slip seats 57 are machined at a bottom edge of the respective radial passages 26, and a conjunctive edge 58 is formed between each slip seat 57 and each radial passage 26.

Each radial passage 26 houses a slip assembly that includes a slip jaw 30 that is pivotally connected to a slip anchor 31 by a pivot pin 60. The axis of the pivot pin 60 is perpendicular to the longitudinal axis of the radial passage 26. The slip anchor 31 is slidably received in the radial passages 26. Each slip jaw 30 includes a gripping surface 62 (FIG. 4) and a biasing surface 56. An angle between the gripping surface 62 and the biasing surface 56 is substantially equal to the angle between the slip seat 57 and the central axis of the axial passage 14. The gripping surface 62 has a transversely curved configuration that corresponds to an external diameter of a tubing string 15 that is to be supported by the slip jaws 30, and the biasing surface 56 is contoured to conform to the shape of the slip seat 57.

The slip spool 10 further includes actuators for moving the respective slip assemblies from a retracted to an extended position. The actuators may be, for example, hydraulic actuators 32 (only one shown), for moving the slip anchors 31 and the slip jaws 30 between the retracted position as shown in FIG. 1 and the extended position as shown in FIG. 2. The hydraulic actuators 32 are aligned with the respective radial passages 26. Each hydraulic actuator 32 includes a cylinder 34 having an outer end 36 and an inner end 38. A radial flange 40 provided at the inner end 38 of the cylinder 34 is bolted to a mounting surface 41 of the side wall 28 of the spool body 12 by mounting bolts 42. A piston 44 connected to a piston shaft 46 is slidably received in the cylinder 34 and the piston shaft 46 is guided by a cylinder end plate 48, which is threadably secured to the inner end of the cylinder 34. The piston shaft 46 is connected to an outer end of the slip anchor 31 so that the slip anchor 31, and the pivotally connected slip jaw 30 move together with the piston 44. Hydraulic nipples 50 are provided at inner and outer ends 38, 36 of the cylinder 34 for connecting pressurized hydraulic fluid lines (not shown) to the hydraulic actuator 32. O-ring seals 52 are provided between the piston 44 and the cylinder 34, and between the piston shaft 46 and the end plate 48. A gasket seal 54 is also provided between the radial flange 40 and the mounting surface 41 of the side wall 28 of the spool body 12.

It should be noted that any other known actuators can be used instead of the hydraulic actuators 32 for reciprocating the slip assemblies. For example, mechanical screws can be used for that purpose, as described in Applicant's co-pending U.S. Patent application, entitled SLIP SPOOL AND METHOD OF USING SAME, which was filed on Dec. 19, 2001.

Each slip jaw 30 in the retracted position, as shown in FIG. 1 is received within the corresponding radial passage 26 of the slip spool, thereby providing full-bore access to the well through the axial passage 14. The slip jaw 30 moves towards and eventually extends into the axial passage 14 of the slip spool 12 as the piston 44 is moved inwardly under hydraulic fluid pressure. After the bearing surface 56 of the slip jaw 30 reaches the conjunctive edge 58 of the axial passage 14 and the corresponding radial passage 26, the slip jaw 30 pivots about the pivot pin 60 and slides over the conjunctive edge 58 while moving together with the slip anchor 31 and the piston 34 until the slip jaw 30 is in the extended position, as shown in FIG. 2. In this extended position, the bearing surface 56 of the slip jaw 30 rests on the slip seat 57 and the gripping surface 62 (FIG. 4) of the slip jaw 30 abuts the exterior surface of the tubing string 15. After the weight of the tubing string 15 is released against the gripping surface 62 of the slip jaw 30, the slip jaw 30 is moved slightly downwardly over the slip seat 57, thereby transferring the weight of the tubing string 15 exerted on the gripping surface 62 into a lateral gripping pressure on the tubing string 15 to support to tubing string 15 in the wellbore. After the slip jaws 30 reach the extended position but before the weight of the tubing string 15 is exerted on the slip jaws 30, the hydraulic actuators 32 are left unlocked in order to permit a position of the respective slip anchors 31 to adjust as the slip jaws 30 are drawn downwardly over the slip seat 57.

Figure 5:
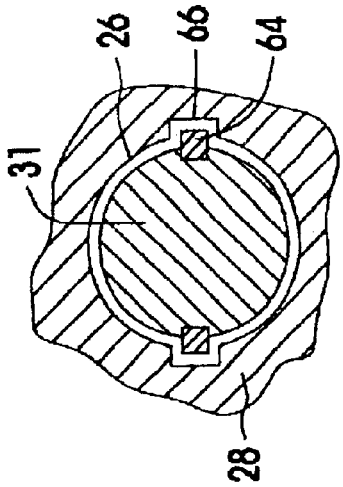
FIG. 5, which appears on sheer 7 of the drawings, is a partial cross-sectional view taken along line 5—5 of FIG. 2, showing key and groove engagement between a slip anchor with a circular cross-section and a radial passage that slidably receives the slip anchor.
Figure 5A:
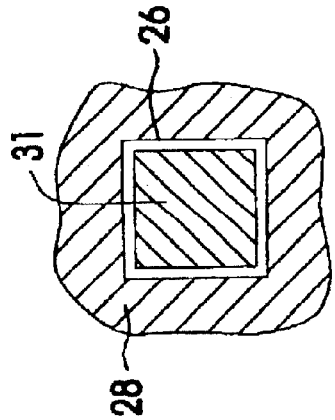
FIG. 5*a*, which likewise appears on sheet 7 of the drawings, is a partial cross-sectional view similar to FIG. 5 showing a slip anchor with a square cross-section slidably received within a radial passage, in accordance with an alternative embodiment of the invention.

The slip anchor 31 is also inhibited from rotating while being moved reciprocally in the radial passage 26, in order to ensure that the slip jaw 30 is correctly seated on the slip seat 57 and that the gripping surface 62 correctly mates with an outer surface of the production tubing 15. In accordance with one embodiment of the present invention, as shown in FIG. 5, the radial passage 26 and the slip anchor 31 has a circular cross-section and keys 64 secured in keyways in the slip anchor 31 are slidably received in longitudinal grooves 66 formed in the sidewall of the radial passage 26. In accordance with another embodiment of the invention, as illustrated in FIG. 5*a*, the radial passage 26 has a square or rectangular cross-section, as does and the slip anchor 31 that reciprocates within the radial passage 26.

With reference again to FIGS. 1 and 2, in order to provide a visual indication of a position of the slip jaw 30, an indicator shaft 68 is connected on its inner end to the piston 44 and reciprocates through a central bore 70 in the outer end 36 of the hydraulic cylinder 34 within a tubular sheath 72, which is aligned with the central bore 70 and is mounted to the outer end 36 of the cylinder 34 by a mounting plate 74. A sight window 76 (FIG. 2) in the wall of the tubular sheath 72 permits the outer end of the indicator shaft 68 to be viewed as the indicator shaft 68 moves with the piston 44. Indicator marks 78 may be provided on the tubular sheath 72 to indicate the position of the associated slip jaw 30 with respect to the axial passage 14. An O-ring 80 is provided between the indicator shaft 68 and the central bore 70 of the outer end 36 of the cylinder 34 to inhibit hydraulic fluid leakage.

Figure 3:
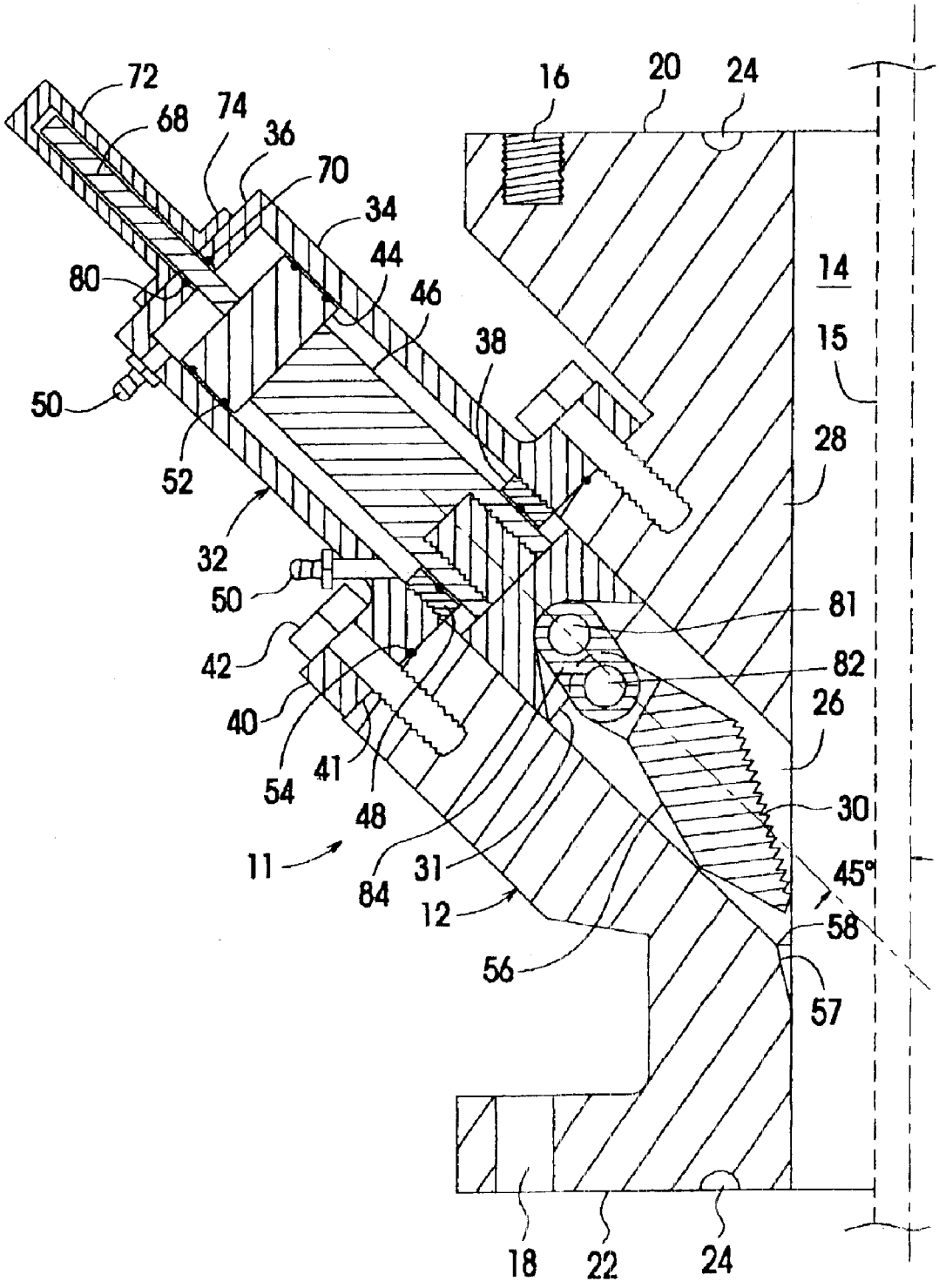
FIG. 3 is a partial cross-sectional view of a slip spool in accordance with another embodiment of the invention, showing the slip assembly in a retracted position.
Figure 4:
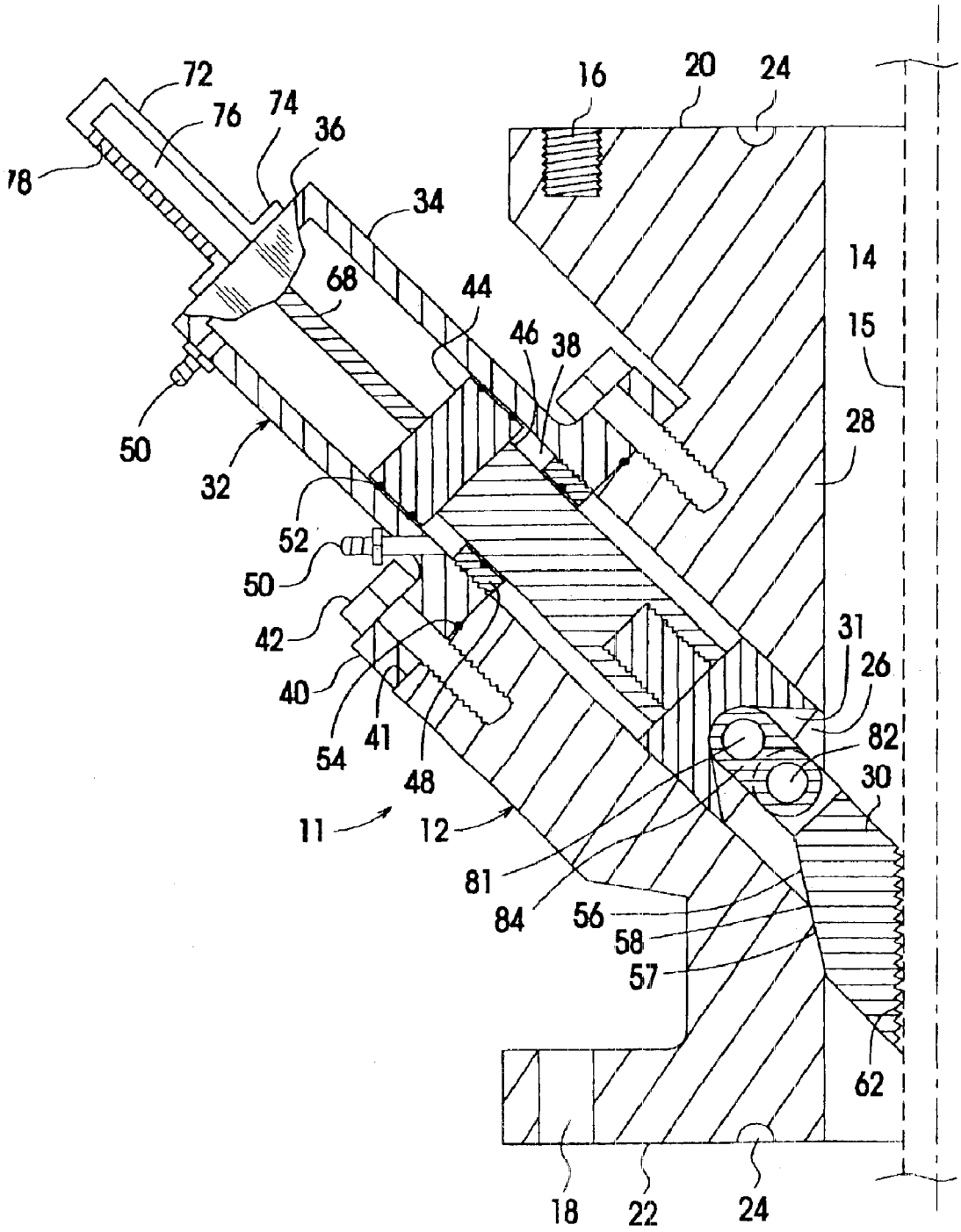
FIG. 4 is a partial cross-sectional view of the slip spool shown in FIG. 3, illustrating the slip assembly in the extended position with the slip jaw seated on the slip seat formed in the radial passage of the slip spool.

FIGS. 3 and 4 schematically illustrate a slip spool 11 in accordance with to a further embodiment of the invention. The slip spool 11 is similar to the slip spool 10 illustrated in FIGS. 1 and 2, and similar components and features which are indicated by similar numerals are not redundantly described.

Unlike the slip spool 10 in which the slip jaws 30 are pivotally connected to the respective slip anchors 31 by pivot pins 60, slip spool 11 includes link members 84 for pivotally interconnecting the respective slip jaws 30 and slip anchors 31. Each link member 84 is pivotally connected at a first end to the slip anchor 31 by a pivot pin 81, and is pivotally connected at an opposite end to the slip jaw 30 by means of a pivot pin 82. The axes of pivot pin 81 and pivot pin 82 are parallel to each other, and perpendicular to the axis of the radial passage 26.

In the retracted position shown in FIG. 3, the link member 84 is not necessarily aligned with the axis of the radial passage 26 because of the weight of the slip jaw 30. When the piston 44 of the actuator 32 moves the slip assembly towards the extended position, and after the slip jaw 30 contacts the conjunctive edge 58 of the axial passage 14, the bearing surface 56 of the slip jaw 30 slides over the conjunctive edge 58 until a lower portion of the gripping surface 62 contacts the exterior surface of the tubing string 15. As the slip anchor 31 continues to move down along the radial passage 26, the slip jaw 30 pivots until the entire gripping surface 62 of the slip jaw 30 contacts the exterior surface of the tubing string 15 and the bearing surface 56 of the slip jaw 30 is seated on the slip seat 57, as shown in FIG. 4. When the weight of the tubing string 15 is released, the downward pressure of the axial force causes a slight downward movement of the slip jaws 30, which is transferred by the wedge shape of the slip jaws 30 into a lateral gripping pressure on the tubing string 15. The link member 84 pivotally interconnecting the slip jaw 30 and the slip anchor 31 provides extra freedom for the slight downward movement of the slip jaw 30, to compensate for variations in the diameter of the production tubing.

Slip spools 10 and 11 illustrated in FIGS. 1–4 may be provided with three or more slip jaws 30 spaced circumferentially about the central passage 14 of the slip body 12.

Figure 6:
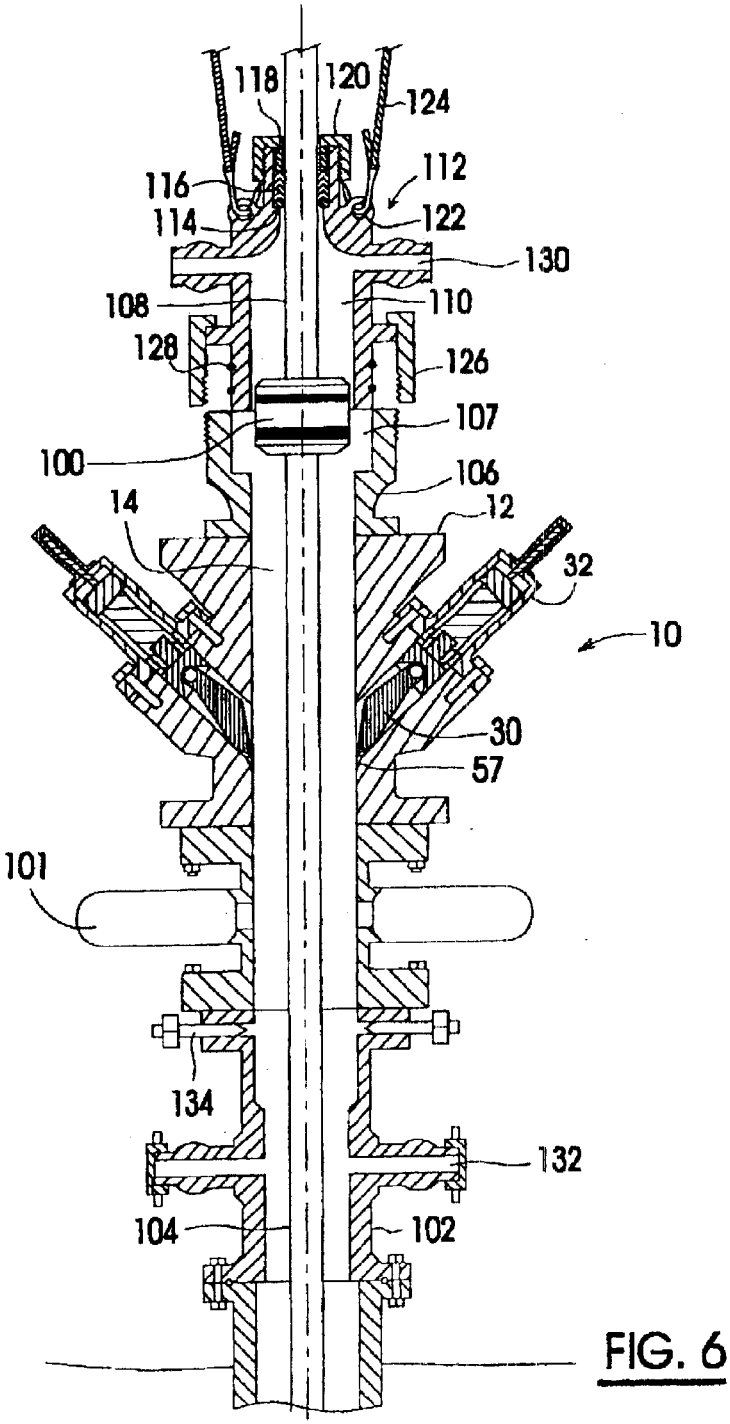
FIG. 6 is a cross-sectional view of a wellhead equipped with the slip spool illustrated in FIG. 1 being used in a procedure for installing a tubing hanger with attached tubing string in a tubing head spool on a live well.

FIG. 6 illustrates a procedure for using the slip spool 10, 11 described above to install a tubing hanger 100 in a tubing head spool 102, or to remove the tubing hanger 100 from the tubing head spool 102. As is well known in the art, the tubing hanger 100 must be set in the tubing head spool 102 in order to suspend the production tubing string 104 in the wellbore after the production tubing string 104 has been run into the well during well completion, as described in Applicant's co-pending U.S. patent application Ser. No. 09/791,980, entitled METHOD AND APPARATUS FOR INSERTING A TUBING HANGER INTO A LIVE WELL, which was filed on Feb. 23, 2001, the specification of which is incorporated herein by reference. It is also well known that the tubing hanger 100 must be removed from the tubing head spool 102 when a mandrel of a BOP protector is to be inserted through the wellhead (see FIGS. 8 and 8*a*), as explained, for example, in Applicant's co-pending U.S. patent application Ser. No. 09/537,629 entitled BLOWOUT PREVENTER PROTECTOR AND METHOD OF USING SAME, which was filed on Mar. 29, 2000 and is also incorporated herein by reference. It is also well known that slips are required to be set and removed to support the tubing string 104 during many other well completion, re-completion and maintenance procedures, particularly if the procedure requires any manipulation of the tubing string 104.

The slip spool 10 permits slip jaws 30 to be extended or retracted under fluid pressures in a live well without killing the well. The apparatus 10 is mounted to a top of a BOP 101, for example which is mounted to a top of a tubing head spool 102. Mounted on the top of the slip spool 12 is a Bowen union 106, well known in the art.

A landing joint 108 is adapted to be connected to the tubing hanger 100. The landing joint 108 is inserted through a passage 110 of an annular adapter 112, as described in Applicant's co-pending U.S. patent application Ser. No. 09/791,980 referenced above. The passage 110 includes a packing cavity at a top thereof, which retains a steel packing washer 114. A high pressure packing 116, such as a chevron packing, is retained above the steel packing washer 114. The high pressure packing 116 closely surrounds and provides a high pressure seal around the landing joint 108 in order to ensure that well fluids do not escape to atmosphere when the tubing hanger 100 is inserted into, or removed from the tubing head spool 102. The high pressure packing 116 is retained by a gland nut 118. A safety nut 120 threadedly engages a spiral thread on an outer periphery of the top end of the annular adapter 112. A top wall of the safety nut 120 projects inwardly to cover the gland nut 118 in order to ensure that the gland nut 118 is not stripped by fluid pressures exerted on the high pressure packing 116.

A side wall of the annular adapter 112 includes at least two eyes or hooks 122 which receive chain or cable 124 that is connected to a hoisting mechanism, such as a boom truck (not shown), in order to suspend the annular adapter 112 while the landing joint 108 is connected to a top end of the tubing hanger 100.

Although FIG. 6 shows only one step of the process, in which apparatus 10 is in its retracted position, the slip jaws 30 of the apparatus 10 are in the extended position (see FIGS. 2 and 4) to support the tubing string 104 after the tubing string 104 is run into the well during the well completion procedure. The slip jaws 30 transfer the axial force exerted on the gripping surface 62 by the weight of the tubing string 104, into a lateral gripping pressure on the tubing string 104 when the wedge shaped slip jaws 30 are forced downwardly against the slip seat 57, as explained above.

A retrievable plug (not shown) seals the tubing string 104 to prevent well fluids within the well from flowing out through the tubing string 104. A top end of the tubing string 104 extends up through the slip spool 12 to at least near a top of the Bowen union 106. After the tubing hanger 100 is connected to the top of the tubing string 104, the annular adapter 112 with the landing joint 108 extending therethrough, is hoisted above the wellhead.

The landing joint 108 is then connected to the top end of the tubing hanger 100, and the annular adapter 112, which is suspended from the cables 124 by the boom truck, or a service rig is lowered and slides down the landing joint 108 so that a lock nut 126 of an annular adapter 112 can be threadedly engaged with the Bowen union 106. O-rings 128 around the annular adapter 112 seal the interface between the annular adapter 112 and the Bowen union 106. Thus the axial passage 14 of the slip body 12 is sealed against leakage when the bleed ports 130 of the annular adapter 112 are closed.

Pressure is then equalized between an annulus of the live well below the tubing rams of the BOP 101 and the axial passage 14 of the slip spool 12, which communicates with the annular adapter 112, using a bleed hose (not shown) connected between the pressure bleed ports 130 on the annular adapter 112 and valves 132 of the tubing head spool 102. After the pressure is equalized and the respective valves are closed, the tubing rams of the BOP 101 are opened in order to permit the tubing hanger 100 to be lowered into the tubing head spool 102.

The landing joint 108 is connected to a lifting mechanism, such as the boom truck of the service rig (not shown) so that the landing joint 108 and the entire tubing string 104 can be lifted by operating the boom truck of the service rig to remove the weight of the tubing string 104 from the slip jaws 30 of the apparatus 10. When the landing joint 108 is lifted slightly, the slip jaws 30 are released, and are free to be moved to the retracted position, as shown in FIG. 6, by operating the hydraulic actuators 32 to clear the axial passage 14 of the slip spool 12. The retracting of slip jaws 30 is performed under well pressure because the tubing rams of the BOP 101 are fully opened. This permits the tubing hanger 100 to be lowered together with the tubing string 104 in one stroke through both the slip spool 12 and the BOP 101, until the tubing hanger 100 is seated in the tubing head spool 102. Once the tubing hanger 100 is seated in the tubing head spool 102, lock bolts 134 are adjusted to lock the tubing hanger 100 within the tubing head spool 102.

The landing joint 108 is then rotated to disconnect it from the tubing hanger 100, and the landing joint 108 is pulled up by the boom truck or the service rig until the landing joint 108 is above the blind rams of the BOP 101. After the blind rams of the BOP 101 are closed, pressure is vented from the annular adapter 112 by, for example, opening the pressure bleed ports 130. Subsequently, the annular adapter 112, the Bowen union 106 and the slip spool 10, if desired, can be removed by the boom truck.

The tubing hanger 100 can be removed from the tubing head spool 102 by performing the above-described process in reverse.

Figure 7:
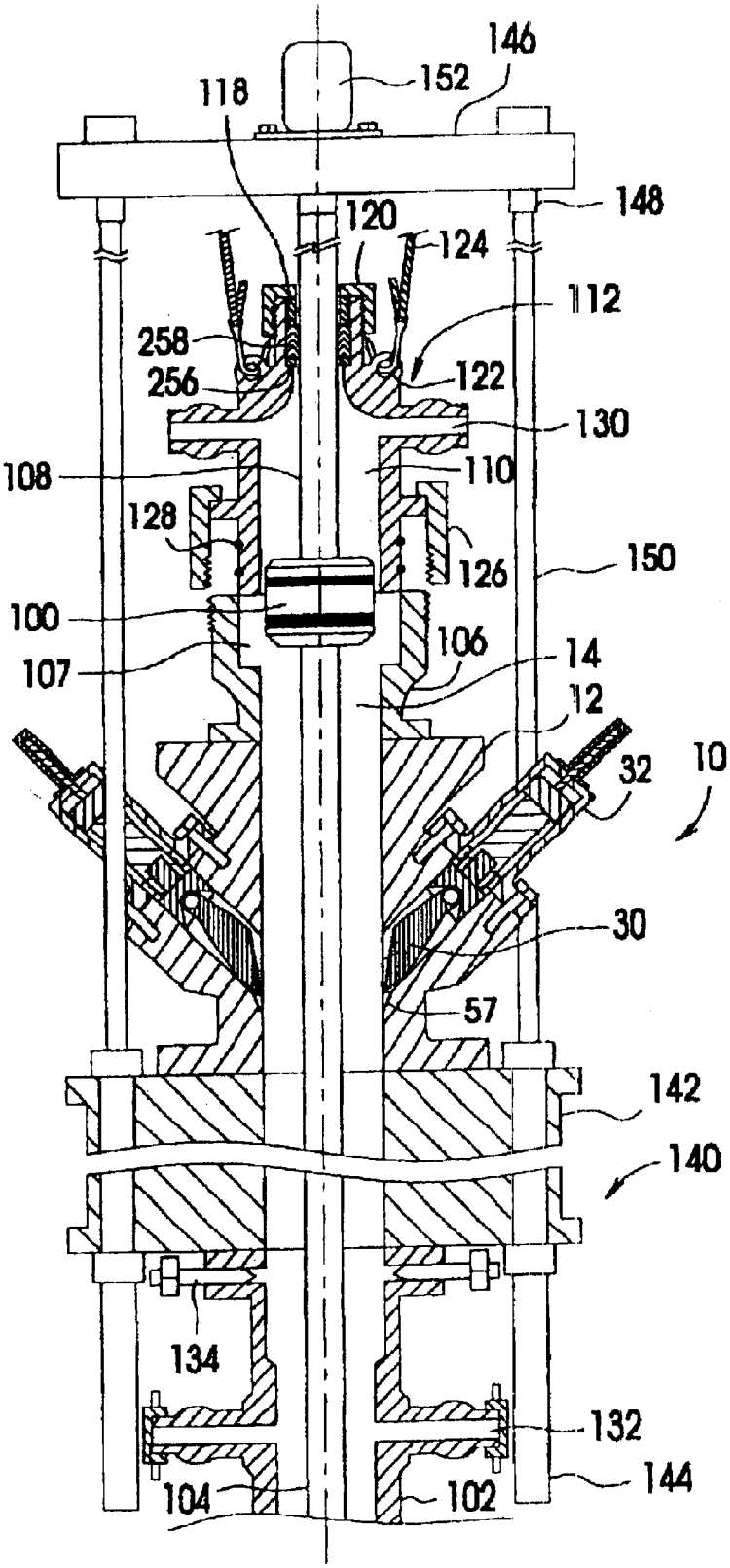
FIG. 7 is a partial cross-sectional view of a wellhead equipped with the slip spool illustrated in FIG. 1 being used in a procedure for installing a tubing hanger with attached tubing string in a tubing head spool on a live well, without using a service rig.

FIG. 7 illustrates another example of using the slip spool 10 in a rigless well servicing operation to install the tubing hanger 100 in the tubing head spool 102 or remove it from the tubing head spool 102. Apparatus 10 is illustrated only in one step of the process in which the slip spool 10 is in its retracted position. In this example, a BOP 140 replaces the conventional BOP 101 shown in FIG. 6. The BOP 140 includes a BOP spool 142 having tubing rams and blind rams similar to those of a conventional BOP. A pair of bi-directional prime movers, such as hydraulic cylinders 144 are secured to opposite sides of the BOP spool 142. The BOP 140 is described in Applicant's co-pending U.S. Patent application entitled SPOOL FOR PRESSURE CONTAINMENT USED IN RIGLESS WELL COMPLETION, RE-COMPLETION, SERVICING OR WORKOVER, filed on Nov. 15, 2001, the specification of which is incorporated herein by reference.

The procedure described below with reference to FIG. 7 is similar to the procedure described above with reference to FIG. 6, and similar steps are not described. The principal difference between the procedure described with reference to FIG. 6 and this procedure is that the lifting and lowering of the tubing hanger 100 and the tubing string 104 are accomplished by operating the hydraulic cylinders 144 of the BOP 140, rather than using a boom truck or a service rig. The landing joint 108 is rotatably suspended from and supported by a lifting beam 146, which is mounted to the top of the hydraulic cylinders 144. Extension rods 148, 150 are connected between the base plate 146 and hydraulic cylinders 144. The annular adapter 112 and the landing joint 108 are lowered to permit the lower end of the landing joint 108 to be connected to the top end of the tubing hanger 100, which has already been mounted to a top of the tubing string 104. The annular adapter 112 is then further lowered until the lock nut 126 of the annular adapter 112 engages the threads of the Bowen union 106 and the O-rings 128 around the annular adapter 112 seal the interface between the annular adapter 112 and the Bowen union 106.

The pressure is equalized as described above and the tubing rams of the BOP 140 are opened to clear the passage for the tubing hanger 100 to be inserted therethrough into the tubing head spool 102. The hydraulic cylinders 144 are actuated to lift the beam 146 and the tubing string 104 suspended therefrom in order to remove the weight of the tubing string 104 from the slip jaws 30 of the slip spool 10. The slip jaws 30 are then retracted from the extended position to clear the axial passage 14 of the slip spool 12. The hydraulic cylinders 144 are then operated to lower the tubing string 104 and insert the tubing hanger 100 into the tubing head spool 102.

A further example of using the apparatus 10 in a live well operation is described below with reference to FIGS. 8 and 8*a*. FIGS. 8 and 8*a* illustrate only one step of the process in which the slip jaws 30 of the slip spool 10,11 are in the retracted position. A mandrel 160 of a BOP protector having a pack-off assembly 162 at a bottom end thereof, is to be inserted through a well head 98 from which a tubing string 104 is suspended. The tubing string 104 is supported by the slip jaws 30 of the slip spool 10,11 which is mounted to a top of the BOP 140 of the wellhead 98. The apparatus 140 is the same as that described above with reference to FIG. 7, and is mounted to a tubing head spool 102. The tubing string 104 is normally supported by a tubing hanger inside the tubing head spool 102 but the tubing hanger has been pulled out of the well in a procedure that is a reverse of the tubing hanger insertion procedure described with reference to FIG. 7.

Thus, the top end of the tubing string 104, which is supported by the slip jaws 30 in their extended condition, extends through the Bowen union 106 to an extent that a distance from the top of the tubing string 104 to the top of the Bowen union 106 is greater than the length of the mandrel 160. The mandrel 160 is equipped with an annular adapter 166. The annular adapter 166 includes packing rings 168 constructed of brass, rubber and fabric disposed within the annular adapter 166 and secured by a gland nut 170. The packing rings 168 and the gland nut 170 define a vertical passage of a same diameter as a periphery of the mandrel 160, to provide a fluid seal between the mandrel 160 and the annular adapter 166.

The mandrel 160 is connected at its top end to a connector 172 that includes a base plate 174. The connection of the top end of the mandrel 160 to the connector 172 is described in detail in Applicant's co-pending patent applications referenced above. The connector 172 further includes a lock nut 176 for engagement with the external threads of the annular adapter 166. A fracturing head 178 having a central passage 180, and at least two radial passages 182, is mounted to the top of the base plate 174. Two high pressure valves 184 are mounted to the fracturing head 178 to close the respective radial passages 182. The combination of the fracturing head 178 and the base plate 174, with all other components attached thereto is hoisted above the wellhead 98. The mandrel 160 is then aligned with the tubing string 104 and is lowered over the tubing string 104 until the pack-off assembly 162 at the bottom end of the mandrel 160 is inserted into the axial passage 14 of the slip spool 12 above the slip jaws 30 and the annular adapter 166 is received in the Bowen union 106. The lock nut 169 of the annular adapter 166 is then connected to the Bowen union 106 to securely lock the annular adapter 166 to the Bowen union 106. The O-rings 167 seal the interface between the annular adapter 166 and the Bowen union 106. The top of the tubing string 104 which has a pin thread 186, extends above the top end of the fracturing head 178.

A tubing adapter 188 is then connected to the top end of the tubing string 104. The tubing adapter 188 is also connected to the top of the fracturing head 178. Extension rods 148 of an adequate length are then connected at their lower end to the piston ram 150 of the respective hydraulic actuators 144 and at their upper end to the base plate 174 using bolts 190 and a connector 192. After the base plate 174 is connected to the hydraulic cylinders 144, a high pressure valve 194 (partially shown) can be hoisted by the boom truck (not shown) to the top of the tubing adapter 188. The high pressure valve 194 is then mounted to the top of the tubing adapter 188.

At this stage the slip spool 10 is in its extended position, and the weight of the tubing string 104 is supported by the slip jaws 30 of the apparatus 10 by the gripping pressure exerted on the tubing string 104. In order to retract the slip jaws 30 to clear the axial passage 14 of the slip spool 12, the weight of the tubing string 104 must be removed by operating the hydraulic actuators 144 to extend piston rams 150 to raise the base plate 174. This is done after the well pressure is equalized across the BOP and the tubing rams (not shown) of the BOP 142 are opened.

After the tubing rams of the BOP 140 are opened and the slip jaws 30 are moved to the retracted position (as shown in FIG. 8*a*), the cylinders 144 are operated to lower the mandrel 160 down through the slip spool 12 and the BOP 140. When the mandrel 160 is in an operating position, the bottom end of the pack-off assembly 162 is seated against a bit guide 196 (FIG. 8A) connected to a top of the well casing 198, and provides a seal to isolate the wellhead components from stimulation fluid pressures.

The mandrel 160 has optional and variable-length extension sections. Thus, the assembled mandrel 160 including the pack-off assembly 162, is pre-adjusted in length to ensure that the lock nut 176 can be threadedly engaged with the annular adapter 166 when the pack-off assembly 162 is seated against the bit guide 196.

A conventional BOP without hydraulic cylinders, for example, the BOP 101 illustrated in FIG. 6, may be used in place of the BOP 140 shown in FIG. 8*a*. If so, the base plate 174 is connected to a service rig or a mandrel injection tool adapted to stroke the mandrel down through the wellhead.

Figure 8B:
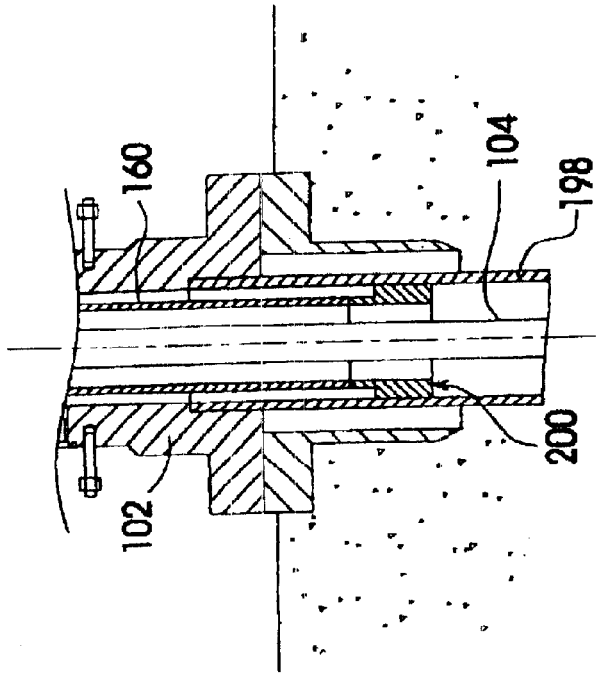
FIG. 8*b* is a partial cross-sectional view of a lower portion of a wellhead in which a mandrel of a blowout preventer protector equipped with a sealing nipple is inserted by the equipment illustrated in FIGS. 8 and 8*a*, in order to seal off against a casing of the well.
Figure 8:
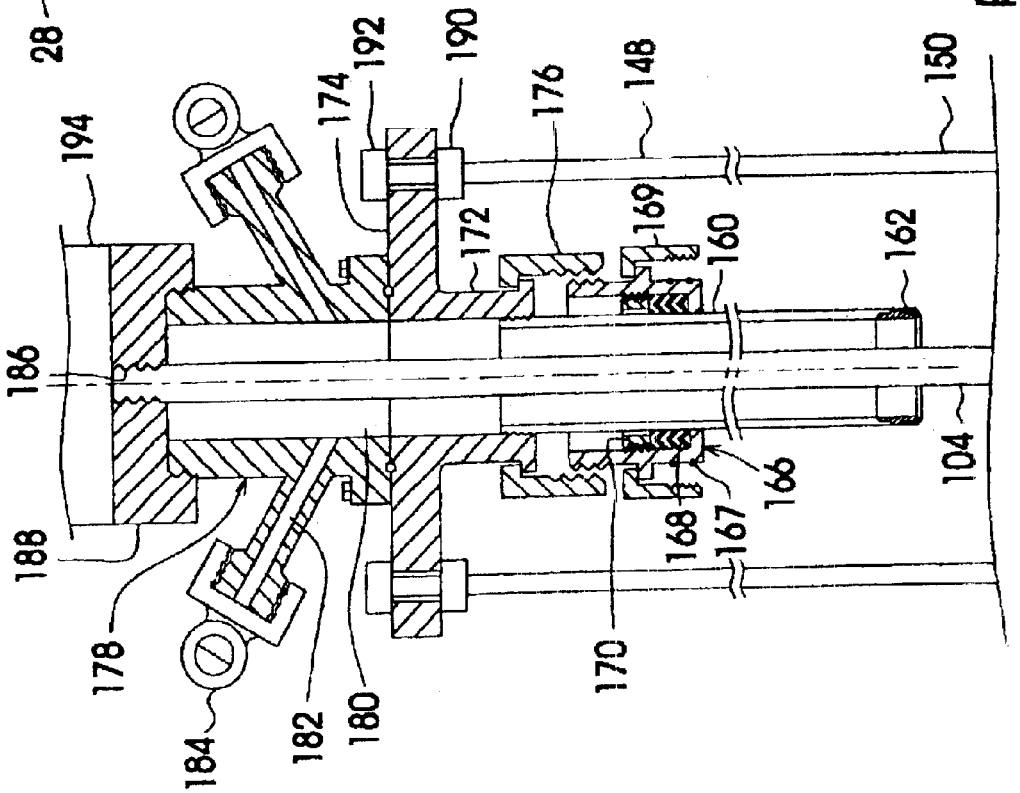
FIGS. 8 and 8*a* are cross-sectional views of a wellhead equipped with the slip spool shown in FIG. 1 being used in a procedure for inserting a mandrel of a blowout preventer protector connected to a tubing string through the wellhead without using a service rig.
Figure 8A:
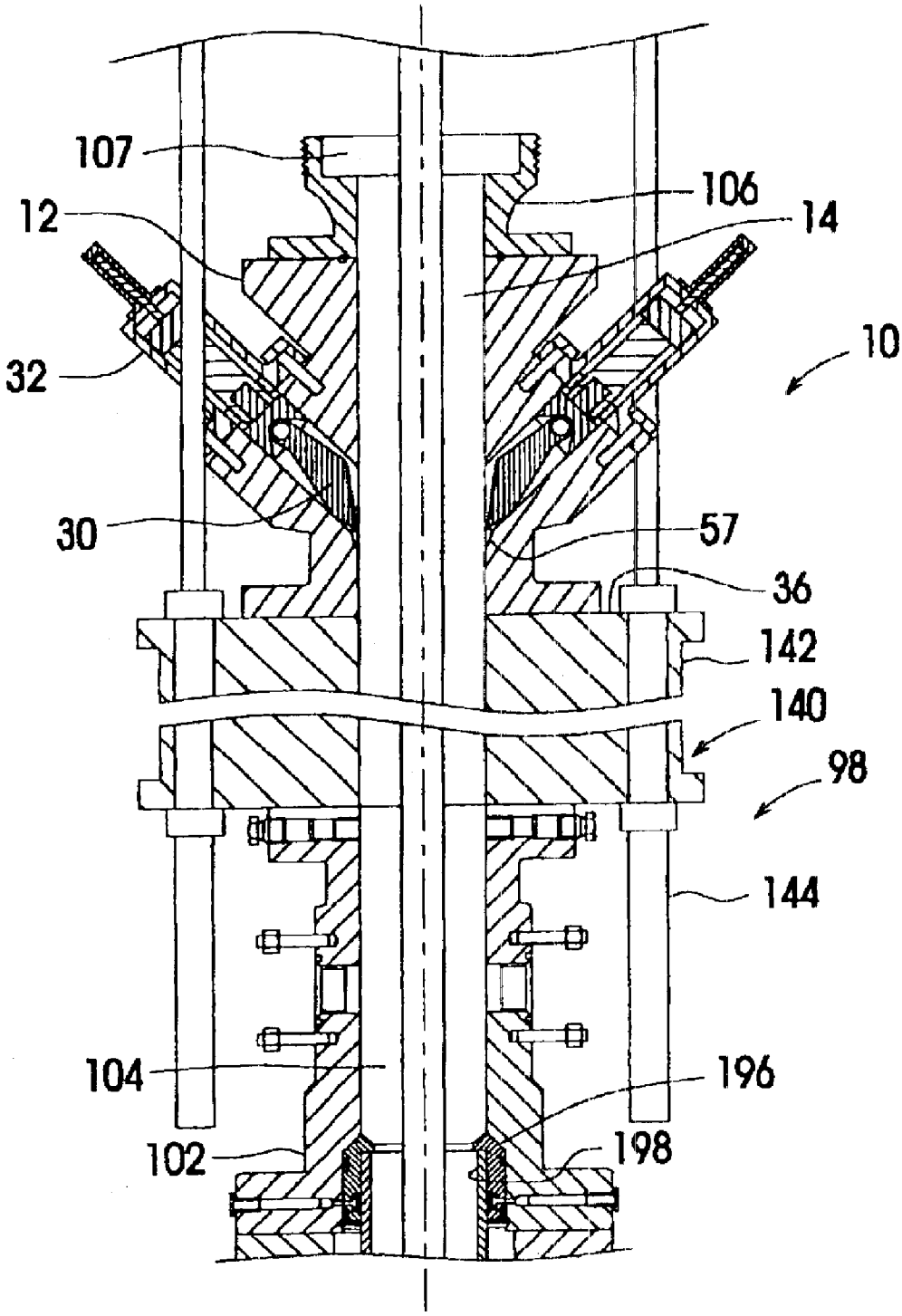

FIG. 8*b* illustrates a variation of the well stimulation procedure described with reference to FIGS. 8 and 8*a*. The mandrel 160 is inserted into a live well with the tubing string 104 suspended by the slip jaws 30 of the slip spool 10 mounted on the wellhead as shown in FIG. 8*a*. The bottom end of the mandrel 160 is extended into the well casing 198 and seals against the well casing 198. A sealing assembly 200 attached to a bottom end of the mandrel 160 includes at least one cup having a resilient depending skirt, as described in Applicant's co-pending U.S. patent application Ser. No. 09/537,629, filed Mar. 29, 2000 for a Blowout Preventer Protector and Method of Using Same, the specification of which is incorporated herein by reference. When the sealing assembly 200 is inserted into the well casing 198, the cup of the sealing assembly 200 radially expands under well pressure against an inner surface of the well casing 198, thereby sealing against the well casing 198. Otherwise, the equipment and tools are the same as used in the operation described with reference to FIGS. 8 and 8*a* and the procedure for using the slip spool 10,11 is the same.

Although the invention has been described with reference to well completion, re-completion and maintenance procedures in which slips are required to support the weight of a tubular string in a well bore, the slip spool 10,11 is useful in any application in which a tubing string must be temporarily suspended in a wellbore.

As will be understood by those skilled in the art, the orientation of the slip spool 10,11 in a well control stack is immaterial to its function. Consequently, in high pressure well conditions the slip spool 10,11 can be installed in a inverted orientations and used as a snubbing spool. Likewise, two slip spools 10,11 can be stacked in opposite orientation to provide both snubbing and slip control of a tubing string. Because the slip spools 10,11 are pressure containment spools that can be constructed to any desired pressure rating, well servicing procedures in which production tubing is controlled using the slip spool are significantly simplified, proceed more quickly and more safely.

The embodiments of the invention described above should be understood to be exemplary only. Modifications and improvements to those embodiments of the invention may become apparent to those skilled in the art. The foregoing description is therefore intended to be exemplary rather than limiting, the scope of the invention is intended to be limited solely by the scope of the appended claims.

I claim:

1. An apparatus for selectively supporting a tubing string suspended in a wellbore comprising:

a spool having a bottom flange for mounting to a pressure containment spool above a tubing head spool of a wellhead, the spool having an axial passage to be aligned with the wellbore for permitting the tubing string to extend therethrough, and at least two radial passages extending through a sidewall of the spool and communicating with the axial passage, each of the radial passages extending inwardly and downwardly at a first angle relative to a central axis of the axial passage;

a slip assembly slidably received within each of the respective radial passages, each slip assembly including a slip jaw pivotally mounted to and slidable together with a slip jaw anchor; and means for moving the respective slip assemblies between an extended position in which the slip jaws are inserted into an annulus between the tubing string and the sidewall for gripping the tubing string, and a retracted position in which the slip jaws clear the axial passage of the spool.

2. An apparatus as claimed in claim 1 wherein each of the slip jaws comprises a gripping surface and an opposed bearing surface forming a second angle therebetween, the second angle being more acute than the first angle.

3. An apparatus as claimed in claim 2 wherein each radial passage in the side wall of the spool comprises a slip seat for supporting the slip jaw when it engages the tubing string.

4. An apparatus as claimed in claim 3 wherein the slip seat is disposed at an angle with respect to the central axis of the axial passage, the angle being substantially equal to the second angle defined by the gripping and bearing surfaces of the slip jaw.

5. An apparatus as claimed in claim 4 wherein the bearing surface of each of the slip jaws rests on the slip seat and the gripping surface of each slip jaw rests against an exterior surface of the tubing string when the respective slip assemblies are in the extended position.

6. An apparatus as claimed in claim 1 wherein the radial passages have a square or a rectangular cross-section and the respective slip assemblies have a corresponding cross-section.

7. An apparatus as claimed in claim 1 wherein the slip jaw anchors have a circular cross-section with protruding key members, and the radial passages have a circular cross-section with longitudinal grooves that receive the key members, and the key members guide sliding movement of the slip anchors in the respective radial passages.

8. An apparatus as claimed in claim 1 wherein the means for moving the respective slip assemblies comprises a hydraulic actuator operatively mounted to the spool and aligned with each of the respective radial passages of the spool.

9. An apparatus as claimed in claim 8 wherein each of the hydraulic actuators comprises an indicator for indicating a radial position of a corresponding one of the slip assemblies.

10. An apparatus as claimed in claim 1 further comprising a link member interconnecting each slip jaw anchor with a corresponding slip jaw, each link member having first and second ends respectively pivotally connected to the slip jaw anchor and the slip jaw.

11. A method for selectively supporting a tubing string suspended in a wellbore of a live well during a well maintenance procedure, comprising steps of:

mounting a slip spool to a wellhead of the live well, the slip spool including an axial passage aligned with the wellbore and at least two radial passages extending through a sidewall of the slip spool and communicating with the axial passage, each of the radial passages extending inwardly and downwardly at a first angle relative to a central axis of the axial passage, a slip assembly slidably supported within each of the respective radial passages, each slip assembly including a slip jaw pivotally mounted to a slip anchor; and means for moving the respective slip assemblies between an extended position in which the slip jaws are inserted into an annulus between the tubing string and the sidewall, and a retracted position in which the slip jaws clear the axial passage of the slip spool;

connecting a pressure control means to a top of the slip spool for containing well pressure in the axial passage, while permitting any one of a tubular, a downhole tool and a wellhead component to be inserted through the axial passage into the live well; and moving the respective slip assemblies between the extended and retracted positions as required to support the tubing string during the well maintenance procedure.

12. A method as claimed in claim 11 wherein after connecting the pressure control means, the method further comprises:

balancing pressure between the well and the axial passage of the slip spool; and operating a flow control mechanism in the wellhead, as required, to open the wellbore in order to permit the any one of a tubular, a downhole tool and a wellhead component to be inserted into the well, under well pressure.

13. A method as claimed in claim 11 further comprising a step of removing a load weight from the slip jaws before the slip assemblies are retracted from the extended position.

14. A method as claimed in claim 12 wherein the maintenance procedure is a well completion or re-completion procedure, and the method further comprises:

connecting a Bowen union to the top of the slip spool;

hoisting a landing joint and an annular adapter into position over the slip spool;

connecting the landing joint to a tubing hanger that has been mounted to a top of the tubing string;

lowering the annular adapter relative to the landing joint and connecting the annular adapter to the Bowen union;

lifting the landing joint to remove the weight of the tubing string from the slip jaws before moving the slip assemblies from the extended position to the retracted position; and lowering the tubing string to insert the tubing hanger through the wellhead into a tubing head spool of the live well.

15. A method as claimed in claim 12 wherein the well procedure is a well stimulation procedure and the method comprises:

connecting a Bowen union to the top of the slip spool;

hoisting a fracturing head that supports a mandrel and an annular adapter into position over the slip spool;

lowering the mandrel and the fracturing head over the tubing string so that a top of the tubing string extends above a top of the fracturing head;

connecting the annular adapter to the Bowen union;

mounting a tubing adapter to the top of the tubing string, and connecting the tubing adapter to the fracturing head;

lifting the fracturing head to remove a weight of the tubing string from the slip jaws before moving the slip assemblies from the extended position to the retracted position; and inserting the mandrel through the wellhead into a sealing engagement that isolates pressure-sensitive components of the wellhead from exposure to well stimulation fluid pressures.

16. A method as claimed in claim 11 further comprising a step of inserting the any one of a tubular, a downhole tool and a wellhead component through the wellhead into an operative position in the live well using prime movers incorporated into a spool for pressure containment having a flow control mechanism for selective containment of pressurized fluid within the wellbore, the spool for pressure containment being mounted in the wellhead below the slip spool.

17. A method as claimed in claim 16 further comprising a step of using the prime movers to lift the tubing string in order to remove weight from the slip jaws when the slip assemblies are to be retracted from the extended position.

* * * * *